United States Patent [19]

Baliva

[11] Patent Number: 4,592,674

[45] Date of Patent: Jun. 3, 1986

[54] CONCRETE MANHOLE

[76] Inventor: Michael G. Baliva, 161 Sunset St., Rochester, N.Y. 14606

[21] Appl. No.: 889,195

[22] Filed: Mar. 23, 1978

[51] Int. Cl.[4] ..... E02D 29/11

[52] U.S. Cl. ..... 404/25; 52/20; 277/207 A

[58] Field of Search ..... 404/25, 26, 64, 65; 52/20, 19, 21; 285/110, 230, 231, 379, 345; 277/207 A; 264/274

[56] References Cited

U.S. PATENT DOCUMENTS

| | | | |
|---|---|---|---|
| 2,219,289 | 10/1940 | Bennett | 285/231 |
| 2,982,569 | 5/1961 | Miller | 285/230 |
| 2,999,699 | 9/1961 | Lafferty | 285/230 X |
| 3,135,519 | 6/1964 | Ligon | 285/231 X |
| 3,759,280 | 9/1973 | Swanson | 52/21 X |
| 3,759,285 | 9/1973 | Yoakum | 285/230 X |
| 3,787,061 | 1/1974 | Yoakum | 277/164 |
| 3,829,107 | 8/1974 | Machado | 285/230 X |
| 3,891,224 | 6/1975 | Ditcher | 285/230 X |
| 3,913,928 | 10/1975 | Yamaguchi | 285/231 X |
| 3,938,285 | 2/1976 | Gilbu | 52/20 |

*Primary Examiner*—James A. Leppink
*Assistant Examiner*—William P. Neuder
*Attorney, Agent, or Firm*—Joseph C. MacKenzie

[57] ABSTRACT

A manhole barrel is cast with an annular gasket in place in the barrel form. The form has a frusto-conical pallet section grooved for receiving the gasket. Anchors protruding from the gasket become embedded in concrete when the latter is introduced into the form.

9 Claims, 6 Drawing Figures

CONCRETE MANHOLE

FIELD OF THE INVENTION

Manhole barrels and other more or less massive concrete structural elements, are joined together to form larger structures intended to contain and/or conduct fluent material, such as sewage.

PRIOR ART

According to the prior art, such structural elements are manufactured not far from the sites at which they are going to be used. After having been transported to a site, they are assembled into larger structures, such as manholes. The assembly process is generally seen to by the contractor or subcontractor responsible for installing the larger structures.

The assembly procedure is simple and straightforward, unless it is also necessary to seal the joints between the elements, as by inserting gaskets, mastics, or the like, therebetween. More particularly, the contractor or subcontractor is not well-prepared to carry out sealing procedures. Frequently, the sealing procedure is badly done by unskilled hands or a worker whose usual function is to manhandle the elements being assembled. On the other hand, the contractor or subcontractor may call in a skilled craftsman, which means added costs.

Finally, if the joint is to be sealed by a gasket, this can be dislodged or malpositioned by the very act of assembling the structural elements.

SUMMARY OF THE PRESENT INVENTION

According to my invention, a structural element such as a concrete manhole barrel has a generally conical annular gasket embedded in the end thereof, so as to provide in effect an integral, unremovable, but flexible part of the barrel. Also according to my invention, such gasket was in place in the form in which concrete was poured in order to create the barrel. For example, a frusto-conical pallet closes the lower end of a cylindrical barrel form, as usual, except that the pallet has a groove therearound. Before filling the form with concrete (and usually steel reinforcement), the gasket is placed in the groove, so that when the concrete is poured, the gasket becomes embedded in the concrete. Preferably, the interior of the gasket is provided with anchors projecting from the surface thereof, in order to assure a tight bond between the concrete and the gasket.

The barrel is otherwise created following the usual procedures and hauled to the site where it will be used, as by seating it on a base, with its gasket end up, and inserting the concrete header end of a second barrel, so that the resilient material of the gasket is compressed between the two barrels such as to provide a substantially water-tight seal between the two barrels. Being effectively integral with the lower barrel, there is no danger that the gasket will be dislodged or malpositioned during assembling the upper barrel to the lower barrel. In effect, the site contractor or subcontractor procedes with assembling the barrels without having to complicate his task by having to see to sealing the joint or to taking extra precautions to see that the assembly procedure does not adversely affect whatever prior art sealing expedient he might otherwise have seen fit to provide.

While the foregoing description and that which follows is mostly in terms of specific structure, namely, manholes, it is to be understood that such particularity while convenient, is not meant as limitation.

It is to be noted that the Figures are neither drawn to actual scale nor/to scales consistent with one another. Dimensions, materials, and procedures are well-known and, on the whole, are prescribed by specifications issued by various governmental or other authorities, and, for the most part, would not contribute here anything to understanding the nature or practice of my invention. However, of background interest here are pages 69–78 of *CONCRETE PIPE DESIGN MANUAL,* First Edition 1970, prepared by the American Concrete Pipe Association, 1501 Wilson Boulevard, Arlington, Va. 22209.

DESCRIPTION OF THE PREFERRED EMBODIMENT

Figure 1:
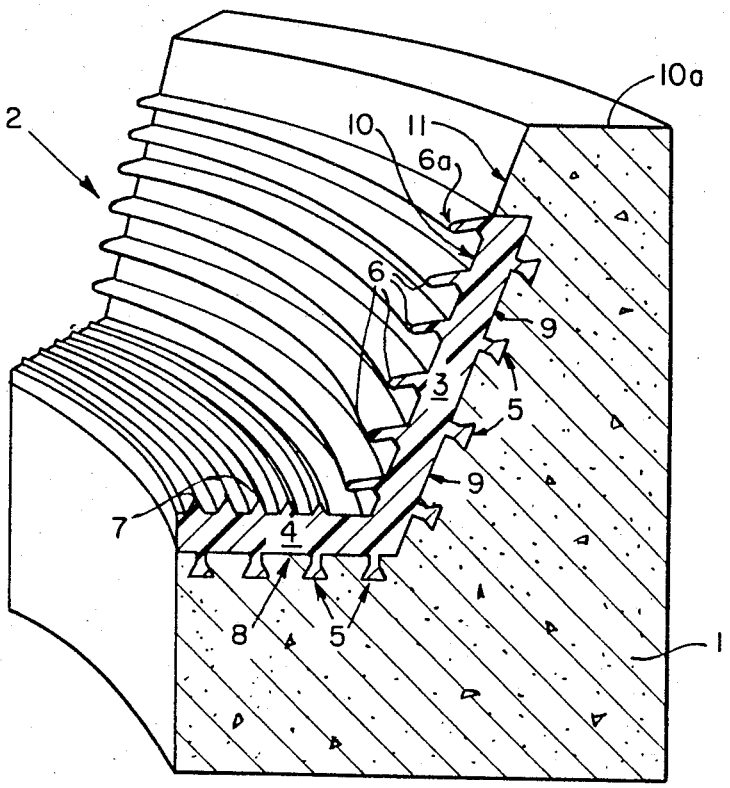
FIG. 1 is a fragmentary, partly-sectional view of a concrete manhole barrel end according to my invention.
Figure 4:
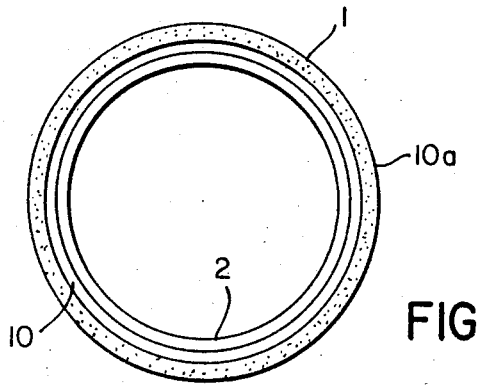
FIG. 4 is a top plan view of a gasket for use as shown in FIGS. 1 and 2, (N.B., certain detail has been omitted from this view for clarity)

In FIG. 1, the upper or pallet end of a concrete manhole barrel 1 has a gasket 2 embedded in said end. Gasket 2 has a frustoconical portion 3, an annular seat flange portion 4, which portions, save for anchors 5, sealing flanges 6, and sealing ridges 7, consist of uniform thickness resilient sealing material, such as rubber. As will be seen from FIG. 4, the gasket 2 is on the whole a sort of ring, from the interior of which project the spaced sealing flanges 6. Flanges 6 extend continuously around the ring, as do the sealing ridges 7 projecting from the upper surface of the seat flange portion 4.

The anchors 5, shown as continuous annular flanges, which have a cross-section substantially in the form of frusta of cones are joined to the exterior of the gasket, oriented as shown in FIG. 1.

The lower surface 8 of seat flange portion 4 is everywhere flat, except for continuous annular anchors 5 projecting downwardly therefrom, and is everywhere in contact with the concrete of the end of the barrel 1. The external surface 9 of portion 3 is everywhere frustoconical, except for anchors 5, and also is everywhere in contact with the concrete of the end of the barrel 1.

In addition, frusto-conical portion 3 is itself embedded in the concrete of the end of the barrel 1, and its exposed internal surface 10 is everywhere frustoconical, and, in effect a continuation of the frustoconical surface 11 extending continuously around the inner extremity of the barrel 1.

Figure 5:
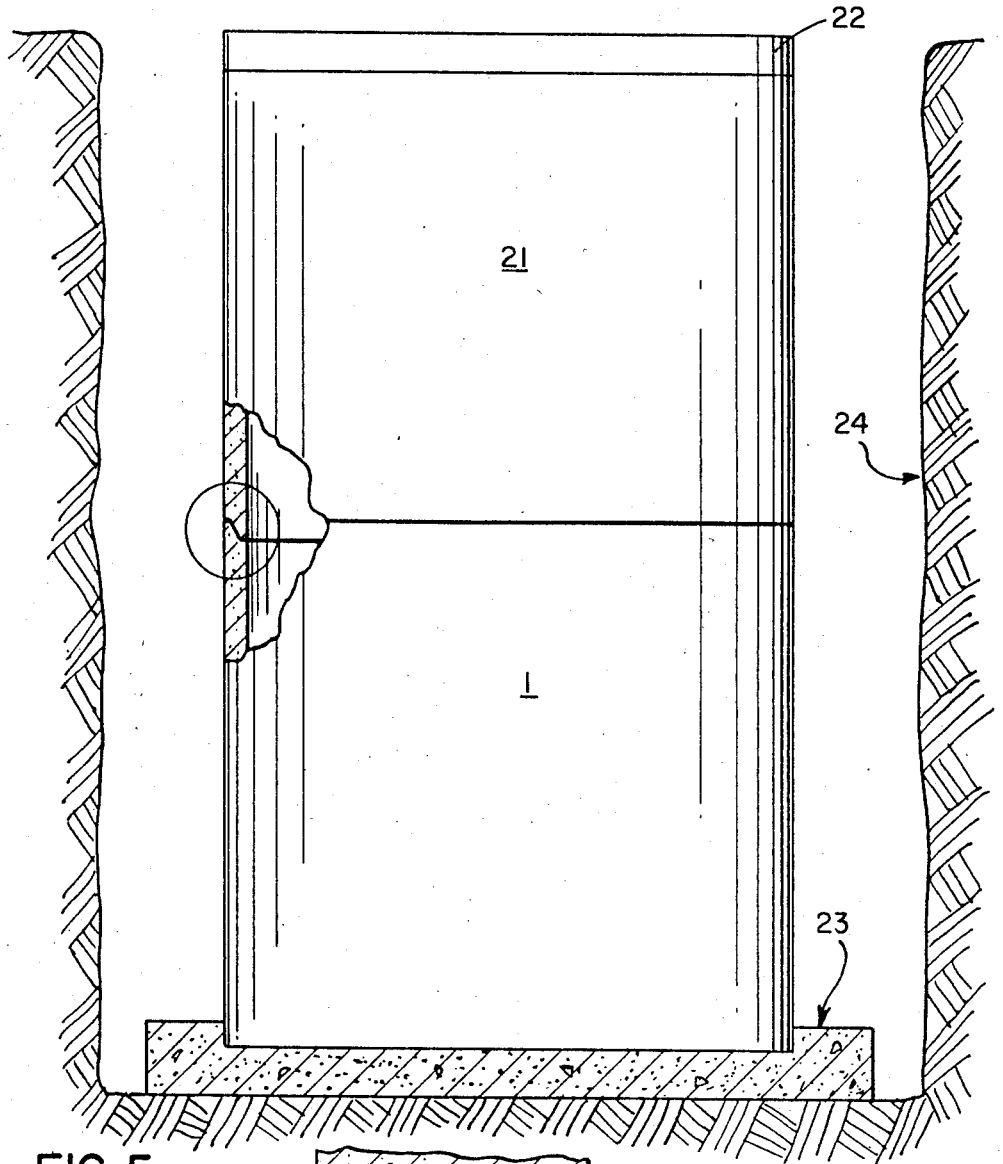
FIG. 5 is an elevation partly in section of a pair of barrels joined together, FIG. 6 being an enlargement of the encircled portion of FIG. 5.

When the barrel is finished, the internal surface 10 of the gasket is substantially continuous (except for flanges 6) with surface of the interior of the barrel. In FIG. 5 is shown a manhole-like structure comprising barrel 1, having a barrel 21 on top, wherein the barrel 21 is closed by a cover 22 and the whole structure is supported by a concrete base 23, at the bottom of an excavation 24.

As will be seen from FIG. 5, the lower end of the barrel 21 has a male frusto-conical header end complementing the female frusto-conical pallet end of the barrel 1. The sealing flanges 6 of the frusto-conical portion 3 of gasket 2 are compressed against the frusto-conical surface 25 of the male header end of barrel 21, and an annular flat seat 26, extending radially inwardly at the larger extremities of the frustoconical male header end of barrel 21, has sealing ridges 7 compressed against it. The compressive force is of course due to the weight of barrel 21 and cover 22.

Figure 6:
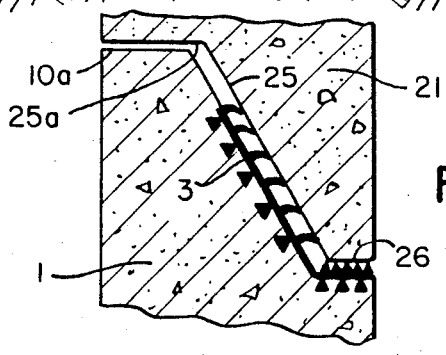

The number of sealing flanges 6 is in itself not critical. However, the space between header end and pallett end and between sealing flanges should be such that when the sealing flanges are compressed they will seal, but will not be deflected all the way to surface 10, or into contact with their nearest neighbor. It is also important that gasket portion 3 not bear the weight of the barrel or barrels above it, i.e., the weight of barrel 21 is to bear directly on barrel 1, not through the gasket. Preferably, the concrete ends of barrels 1 and 21 are in direct contact with each other. Thus, the upper surface 10*a* at the end of barrel 1 provides a seat which contacts or seats on a corresponding seat provided by the corresponding lower surface 25*a* of barrel 21, or at least the weight of the upper barrel is borne by flange portion 4 of gasket 2 in the event that 10*a* does not reach the corresponding lower surfaces 25*a* of barrel 21. (N.B., the surface 10*a* and 25*a* are shown as slightly separated in the enlarged view of FIG. 6 for clarity.) The uppermost sealing flange 6*a* serves a dual function in that when the barrel is poured it keeps the concrete out of the spaces between the sealing flanges. The flange 6*a* actually contacts the pallet 20 in order to bar ingress of concrete to groove 20*a*.

Figure 2:
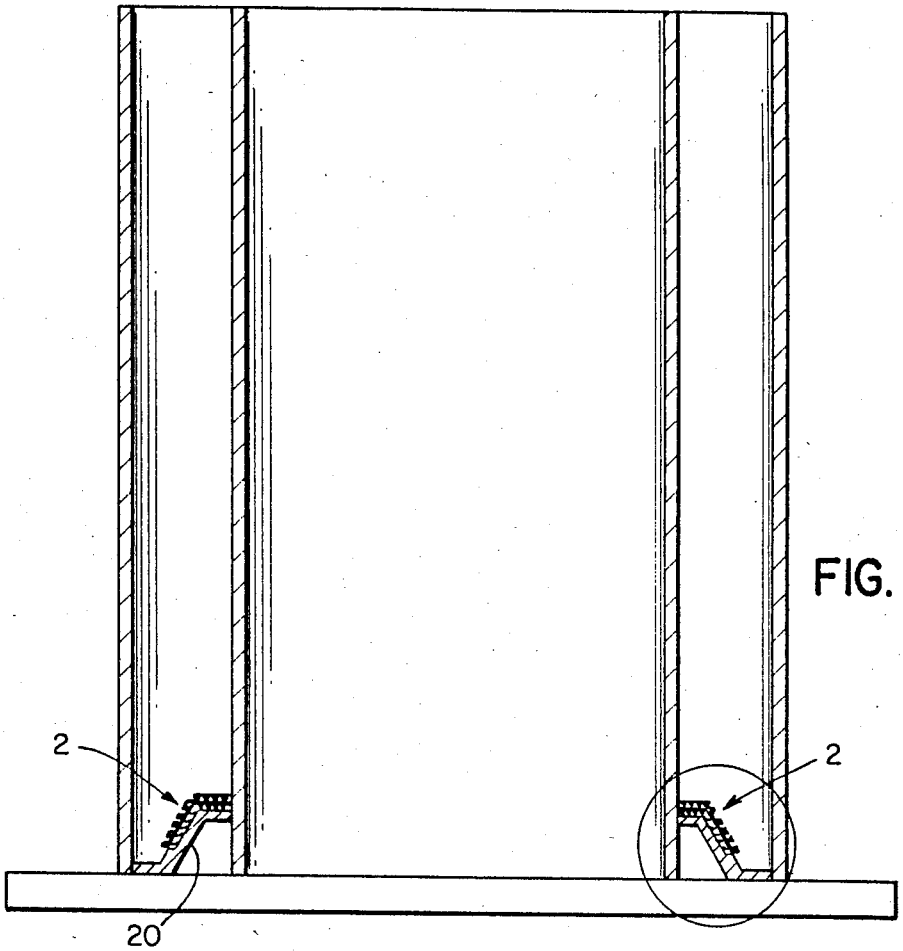
FIG. 2 is a sectional view illustrating the preliminary phase of a procedure according to the invention, for creating a concrete manhole barrel having an integral sealing gasket, FIG. 3 being an enlargement of the encircled portion of FIG. 2.
Figure 3:
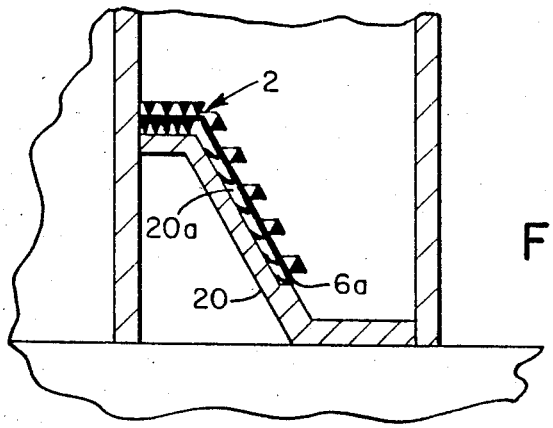

As will be seen from FIG. 2, groove 20*a* is not deep enough to fully accept gasket. This is necessary because when the concrete is poured, the weight thereof will force the gasket more deeply in the groove by collapsing flanges 6 and ridges 7 to a certain extent, preferably just enough to position surfaces 10 and 11 as shown in FIG. 1, when the gasket becomes loaded by the fresh concrete poured into the form.

I claim:

1. A manhole structure having two barrels, one thereof having a male end, and the other thereof having a female end; said male end having an external peripheral surface, said female end having an internal peripheral surface, and said female end having said male end therein;

said barrels being positioned vertically, one on top and one on the bottom, and there being support means for causing the weight of the top barrel to be supported by the bottom barrel, while maintaining an annular space between said surfaces;

said space having an annular gasket therein, said gasket having resilient sealing flange means extending around said space and in sealing contact with one said peripheral surface, and said gasket having anchor means extending around said space, and being embedded in the said end having the other said peripheral surface; and said gasket having an annular seat flange extending therearound, said seat flange extending away from said space and horizontally between said barrels, and each said barrel having an annular surface sealingly contacting said seat flange.

2. The manhole structure of claim 1, wherein said seat flange has resilient sealing ridge means contacting one said annular surface and anchor means embedded in the said end having the other said annular surface.

3. The manhole structure of any one of claims 1 and 2, wherein said anchor means projects from surface of said gasket, and such surface is everywhere in contact with surface of the said end in which said anchor means is embedded.

4. The manhole structure of any one of claims 1 and 2, wherein each of said peripheral surfaces and gasket is frusto-conical in form, and said peripheral surfaces are mutually parallel and spaced from one another by said annular space.

5. A manhole structure having two barrels, one thereof having a male end, and the other therof having a female end; said male end having an external peripheral surface, said female end having an internal peripheral surface, said female end having said male end therein; said barrels being positioned vertically, one on top and one on the bottom and there being support means for causing the entire weight of the top barrel to be borne by the bottom barrel, while maintaining an annular space between said peripheral surfaces; said space having an annular gasket therein, said gasket having vertically-spaced resilient sealing flanges extending from said gasket and around said space and being in downwardly-deflected, circumferential sealing contact with one said peripheral surface, and said gasket having anchor means extending around said space, said anchor means being embedded in the said end having the other said peripheral surface, said flanges being at the same time out of contact, both with each other and with any gasket portions as may be adjacent said flanges.

6. The manhole structure of claim 5, wherein said gasket has an annular seat flange extending therearound, said seat flange extending away from said space and horizontally between said barrels, each said barrel having an annular surface sealingly contacting said seat flange.

7. The manhole structure of claim 6, wherein said seat flange has resilient sealing ridge means contacting one said annular surface and anchor means embedded in the said end having the other said annular surface.

8. The manhole structure of any one of claims 5, 6 and 7, wherein said anchor means projects from surface of said gasket, and such surface is everywhere in contact with surface of the said end in which said anchor means is embedded.

9. The manhole structure of any one of claims 5, 6 and 7, wherein each of said peripheral surfaces and said gasket is frusto-conical in form, and said peripheral surfaces are mutually parallel and spaced from one another by said space.

* * * * *